US008317192B2

(12) United States Patent
Karikusa et al.

(10) Patent No.: US 8,317,192 B2
(45) Date of Patent: Nov. 27, 2012

(54) SHEET CONVEYANCE UNIT AND IMAGE FORMING APPARATUS INCLUDING SAME

(75) Inventors: Yuji Karikusa, Ibaraki (JP); Junji Shirakawa, Ibaraki (JP); Yutaka Shoji, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/067,437

(22) Filed: Jun. 1, 2011

(65) Prior Publication Data

US 2011/0316226 A1 Dec. 29, 2011

(30) Foreign Application Priority Data

Jun. 28, 2010 (JP) ..... 2010-146323
Mar. 31, 2011 (JP) ..... 2011-078172

(51) Int. Cl.
*B65H 9/04* (2006.01)

(52) U.S. Cl. ..... 271/243; 271/245; 271/246

(58) Field of Classification Search ..... 271/243, 271/245, 246
See application file for complete search history.

(56) References Cited

U.S. PATENT DOCUMENTS

| | | | | |
|---|---|---|---|---|
| 6,011,948 | A * | 1/2000 | Amano et al. | 399/395 |
| 6,934,505 | B2 * | 8/2005 | Shin | 399/395 |
| 2008/0296828 | A1 | 12/2008 | Shoji et al. | |
| 2009/0102117 | A1 * | 4/2009 | Yu et al. | 271/226 |

FOREIGN PATENT DOCUMENTS

| | | | |
|---|---|---|---|
| JP | 60-101558 | A | 6/1985 |
| JP | 61027853 | A * | 2/1986 |
| JP | 64-555 | | 1/1989 |
| JP | 03259860 | A * | 11/1991 |
| JP | 05-338865 | | 12/1993 |
| JP | 05338865 | A * | 12/1993 |
| JP | 06-092518 | | 4/1994 |
| JP | 07-172637 | | 7/1995 |
| JP | 2007022806 | A | 2/2007 |
| JP | 3981485 | | 7/2007 |

OTHER PUBLICATIONS

Abstract of JP 2000233849.

* cited by examiner

*Primary Examiner* — David H Bollinger
(74) *Attorney, Agent, or Firm* — Harness, Dickey & Pierce, P.L.C.

(57) ABSTRACT

A sheet conveyance unit includes first and second conveyance rollers facing each other, a first stopper provided at an axial end portion of the first conveyance roller, projecting radially beyond a circumferential surface of the first conveyance roller, downstream rollers positioned downstream from the first and second conveyance rollers in a sheet conveyance direction, an engaging and disengaging unit to disengage the first and second conveyance rollers from each other, and a controller. The first stopper rotates to a contact position projecting into the sheet conveyance path and to a non-contact position away from the sheet conveyance path as the first conveyance roller rotates. The first stopper moves to the non-contact position after stopping a sheet. The first and second conveyance rollers are disengaged from each other after a leading end of the sheet reaches the downstream rollers, before the first stopper moves to the contact position.

20 Claims, 11 Drawing Sheets

SHEET CONVEYANCE UNIT AND IMAGE FORMING APPARATUS INCLUDING SAME

CROSS-REFERENCE TO RELATED APPLICATIONS

This patent specification is based on and claims priority from Japanese Patent Application Nos. 2010-146323, filed on Jun. 28, 2010, and 2011-078172, filed on Mar. 31, 2011, in the Japan Patent Office, which are hereby incorporated by reference herein in their entirety.

BACKGROUND OF THE INVENTION

1. Field of the Invention

The present invention generally relates to a sheet conveyance unit used in an image forming apparatus, such as a copier, a printer, a facsimile machine, or a multifunction machine including at least two of these functions, and an image forming apparatus including the sheet conveyance unit.

2. Discussion of the Background Art

In image forming apparatuses such as laser printers, generally the following processes are performed.

A sheet feeder picks up sheets of recording media stored in a sheet cassette one by one and feed the sheet to a transfer position, and a toner image is formed on an image bearer such as a drum-shaped or belt-shaped photoreceptor. At the transfer position, the toner image is transferred from the image bearer to the sheet with the position of the toner image on the image bearer aligned with an image position on the sheet, after which the toner image is fixed on the sheet and the sheet is output.

Such image forming apparatuses further includes a registration unit, such as those described below, to time sheet conveyance to coincide with arrival of the toner image at the transfer position so that the toner image can be transferred at an intended position on the sheet.

For example, JP-S64-0555-U proposes a registration unit that includes a pair of registration rollers to transport the sheet timed to coincide with the arrival of the toner image, and a movable gate positioned upstream from the registration rollers in the sheet conveyance direction. The gate can move to block the sheet conveyance path and be away from the sheet conveyance path.

In this approach, the sheet is conveyed a predetermined distance with the leading edge of the sheet stopped by the gate, causing the sheet to curve into a partial loop.

When the gate is away from the sheet conveyance path, the curved sheet is stretched, and then the leading edge of the sheet can enter the nip between the registration rollers due to resilience of the sheet to return to its original shape.

The position where the leading edge of the sheet is clamped by the registration rollers can be the same or similar among multiple sheets due to the resilience of the sheet. Therefore, the timing at which the sheet is transported from the sheet cassette can be constantly in alignment with the arrival of the toner image at the transfer position among the multiple sheets transported successionally.

Although the gate is used in the above-described approach, alternatively, the leading edge of the sheet may be forced to get stuck in the nip between the registration rollers so that the sheet is curved without using the gate.

The above-described approach, however, has several drawbacks. For example, because the gate dedicated to sheet registration is provided separately from the registration rollers, the mechanism is more complicated and the cost is increased.

Additionally, JP-H05-338865-A proposes providing the registration roller with a movable contact member that stops the leading edge of the sheet. The movable contact member is a rotary gate provided via a torque limiter at a rotary shaft of the registration roller. In this configuration, as the registration roller rotates in a normal direction (i.e., sheet feeding direction) and the reverse direction, the rotary gate moves between a position to stop the leading edge of the sheet (i.e., a registration position) and a position to forward the sheet in conjunction with the registration roller (i.e., a non-contact position.

More specifically, the rotary gate moves to the registration position when the registration roller rotates in the direction reverse to the sheet feeding direction to forward the sheet and to the non-contact position from the registration position when the registration roller rotates in the sheet feeding direction. When the rotary gate contacts a sheet guide, the torque limiter does not transmit rotation of the registration roller to the rotary gate, thereby stopping the rotary gate.

SUMMARY OF THE INVENTION

In view of the foregoing, in one illustrative embodiment of the present invention, a sheet conveyance unit includes a first conveyance roller and a second conveyance roller disposed facing each other via a sheet conveyance path along which a sheet of recording media is transported, a first stopper provided at an axial end portion of the first conveyance roller, a pair of downstream rollers positioned downstream from the first and second conveyance rollers in a sheet conveyance direction in which the sheet is transported, an engaging and disengaging unit to engage and disengage the first and second conveyance rollers from each other, and a controller operatively connected to the first and second conveyance rollers as well as the engaging and disengaging unit. The first stopper projects beyond a circumferential surface of the first conveyance roller in a radial direction of the first conveyance roller and rotates to a contact position projecting into the sheet conveyance path to stop the sheet, and to a non-contact position away from the sheet conveyance path in conjunction with rotation of the first conveyance roller. The controller moves the first stopper to the non-contact position after the first stopper stops the sheet. The controller causes the engaging and disengaging unit to disengage the first and second conveyance rollers from each other after a leading-end portion of the sheet arrives at the pair of downstream rollers and before the first stopper is moved from the non-contact position to the contact position.

Another illustrative embodiment of the present invention provides an image forming apparatus that includes an image forming unit and the sheet conveyance unit described above.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
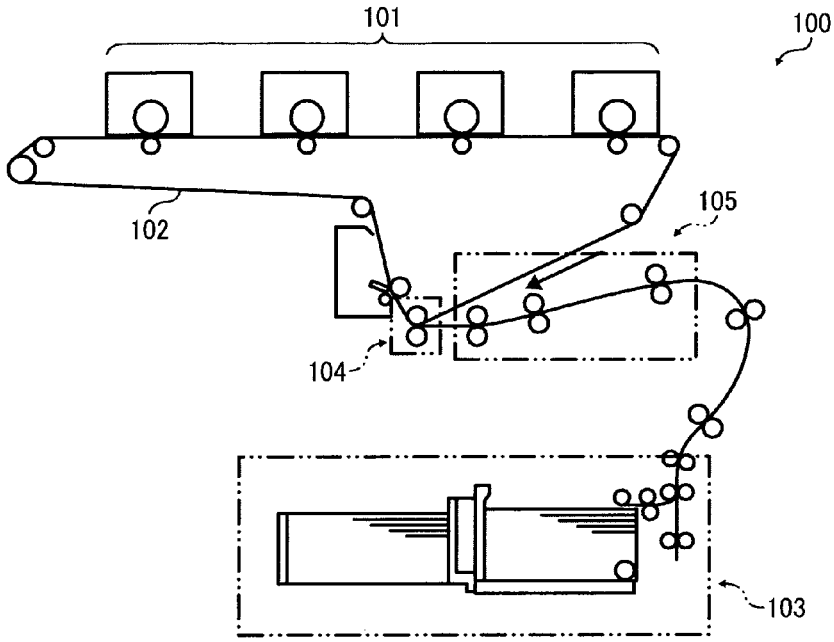
FIG. 1 is a schematic diagram that illustrates an image forming apparatus including a sheet conveyance unit according to an illustrative embodiment of the present invention.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, an image forming apparatus according to an illustrative embodiment of the present invention is described.

FIG. 1 is a schematic diagram that illustrates an image forming apparatus 100 that includes a sheet conveyance unit according to the present embodiment. In the configuration shown in FIG. 1, the image forming apparatus 100 is capable of multicolor image formation.

Referring to FIG. 1, the image forming apparatus 100 further includes multiple image forming units 101 for forming different color toner images, arranged along a linearly extending portion of an intermediate transfer belt 102, a sheet feeder 103, and a secondary transfer unit 104 to transfer an image formed on the intermediate transfer belt 102 onto a sheet of recording media transported from the sheet feeder 103. The image forming units 101 and the intermediate transfer belt 102 together form a primary transfer unit. The sheet conveyance unit includes a registration unit 105 that aligns the timing at which the sheet is transported to the secondary transfer unit 104 with the toner image formed on the intermediate transfer belt 102.

The multiple image forming units 101 forms different color toner images according to a known electrophotographic method. Then, the toner images are transferred from the image forming units 101 and superimposed one on another on the intermediate transfer belt 102.

The sheet feeder 103 picks up the sheet contained in the sheet cassette and transports the sheet to the registration unit 105 that is a main portion of the sheet conveyance unit according to the present embodiment. The sheet conveyance unit includes the registration unit 105 and multiple rollers provided along the sheet conveyance path to transport the sheet.

Figure 2:
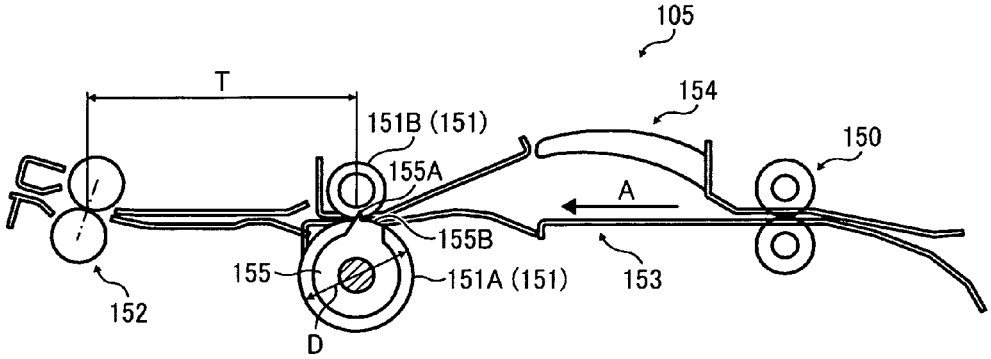
FIG. 2 is a schematic diagram that illustrates a main portion of the sheet conveyance unit shown in FIG. 1.

FIG. 2 illustrates a configuration of the registration unit 105.

The registration unit 105 includes a pair of feed rollers 150, a conveyance roller unit 151 including a gate-side roller 151A and a forwarding roller 151B (hereinafter also collectively "conveyance rollers 151A and 151B"), and a pair of timing rollers 152 arranged, in that order, in a sheet conveyance direction indicated by arrow A shown in FIG. 2. The conveyance rollers 151A and 151B clamp the sheet therebetween and transport the sheet. Each of the pair of feed rollers 150 and the pair of timing rollers 152 is a pair of rollers of identical or similar diameter positioned facing each other across a sheet conveyance path. The conveyance rollers 151A and 151B serve as the first and second conveyance rollers, and the pair of timing rollers 152 serves as a pair of downstream rollers.

Additionally, a lower conveyance guide 153 and an upper conveyance guide 154 are provided along the sheet conveyance path between the feed rollers 150 and the conveyance rollers 151A and 151B. The lower conveyance guide 153 substantially parallels a tangential direction extending from the nip between the feed rollers 150. The upper conveyance guide 154 extends in the sheet conveyance direction and is positioned across the sheet conveyance path from the lower conveyance guide 153. The upper conveyance guide 154 is curved in such a manner that a part of the upper conveyance guide 154 protrudes in a direction away from the lower conveyance guide 153 (upward in FIG. 2). The protruding portion of the upper conveyance guide 154 is positioned at the same position as the position of a curved portion (like a partial loop or arch) of the sheet when the sheet is curved partly, which is described later.

As described above, the conveyance roller unit 151 includes the gate-side roller 151A conveyance rollers 151A and 151B, namely, the gate-side roller 151A on the lower side and the forwarding roller 151B the upper side of the sheet conveyance path in FIG. 2.

The gate-side roller 151A is rotated by a unit 202 (shown in FIG. 5) that engage and disengage the pair of opposed conveyance rollers 151A and 151B from each other. The forwarding roller 151B on the upper side can be moved by the unit 202 toward and away from the gate-side roller 151A.

It is to be noted that, in FIG. 2, reference characters 155 denotes a gate member, 155A denotes a stopper of the gate member 155, 155B denotes a guide surface of the gate member 155, T denotes a distance from the nip between the timing rollers 152 to the stopper 155A of the gate member 155, and D denotes an external diameter of the gate-side roller 151A.

Figure 3A:
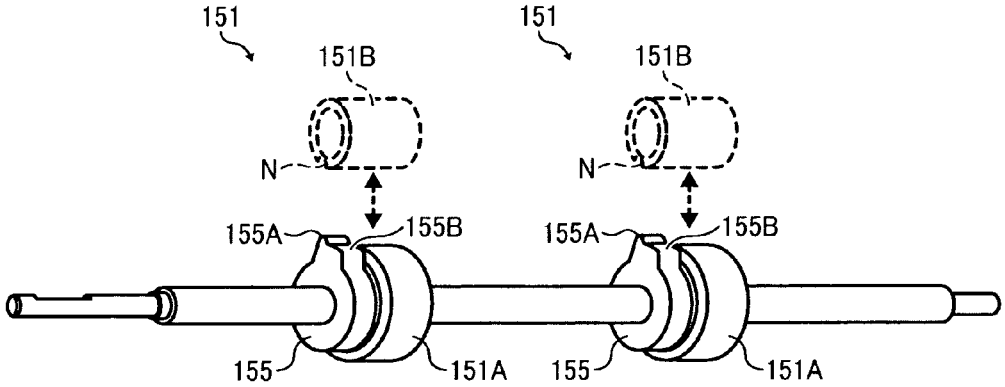
FIGS. 3A and 3B are perspective views illustrating a configuration of a pair of conveyance rollers used in the sheet conveyance unit shown in FIG. 2.
Figure 3B:
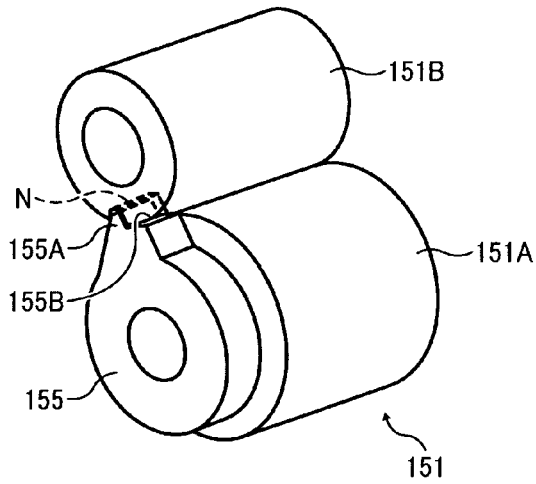

FIGS. 3A and 3B illustrate the gate-side roller 151A in further detail.

In the configuration shown in FIG. 3A, two pairs of the gate-side roller 151A and the forwarding roller 151B are provided, and two gate members 155 are provided coaxially with the respective gate-side rollers 151A. The gate member 155 is provided coaxially with the gate-side roller 151A, supported by a shaft of the gate-side roller 151A, and positioned adjacent to an edge surface of the gate-side roller 151A in the axial direction thereof.

Figure 4A:
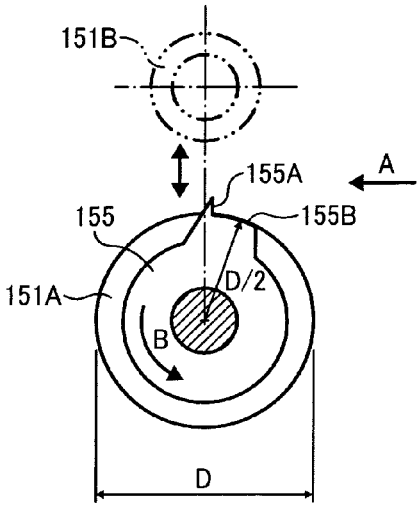
FIGS. 4A and 4B illustrate a configuration of a gate member used for the conveyance rollers shown in FIGS. 4A and 4B.
Figure 4B:
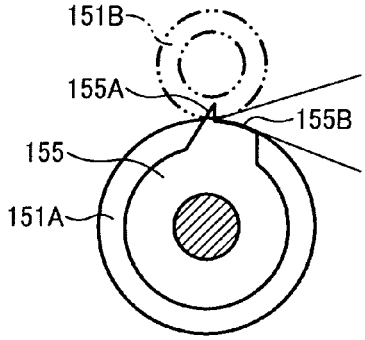

As shown in FIGS. 4A and 4B, the gate member 155 includes the stopper 155A projecting into the sheet conveyance path beyond the circumference of the gate-side roller 151A so as to contact and stop the leading-end portion of the sheet. The stopper 155A extends in a limited portion of the gate member 155 in the circumferential direction. The guide surface 155B of the gate member 155 is continuous with the stopper 155A and has an external diameter identical or similar to that of the gate-side roller 151A.

FIG. 4A illustrates an initial position of the gate member 155.

Referring to FIG. 4A, when the gate member 155 is at the initial position, the leading-end portion of the sheet contacts the stopper 155A and is stopped thereby. More specifically, at the initial position, a trailing-end portion of the stopper 155A in the sheet conveyance direction indicated by arrow A is positioned on a line connecting a center of rotation of the gate-side roller 151A and a center of rotation of the forwarding roller 151B positioned across the sheet conveyance path from the gate-side roller 151A. As the gate member 155 rotates in a direction indicated by arrow B shown in FIG. 4A, the trailing-end portion of the stopper 155A can move to a position away from the sheet conveyance path (hereinafter "non-contact position").

Thus, the leading-end portion of the sheet can contact the stopper 155A at a position upstream from the nip between the gate-side roller 151A and the forwarding roller 151B in the sheet conveyance direction and can be stopped before entering the nip.

With this configuration, the sheet that does not yet enter the nip is not clamped by the gate-side roller 151A and the forwarding roller 151B but can move, which is required to correct skew of the sheet, that is, inclination of the sheet relative to the sheet conveyance direction.

When the leading-end portion of the sheet contacts the stopper 155A, the sheet deforms into a partial loop or arch. When the sheet is further forwarded with the leading-end portion stopped by the stopper 155A, the sheet rotates in such a direction that the curvature of the sheet is reduced by a moment centered about a leading edge of the sheet in contact with the stopper 155A. As a result, the leading-end portion of the sheet contacts the stopper 155A entirely, and thus the skew of the sheet can be corrected.

The guide surface 155B has an external diameter identical or similar to an external diameter of the gate-side roller 151A. As a result, when the stopper 155A is at the initial position, a wedgelike space can be defined by a circumferential surface of the forwarding roller 151B and the guide surface 155B positioned upstream from the nip between the gate-side roller 151A and the forwarding roller 151B in the sheet conveyance direction. With this configuration, the leading-end portion of the sheet can be reliably guided to the nip between the gate-side roller 151A and the forwarding roller 151B and thus reliably contacts the stopper 155A.

It is preferred that the guide surface 155B be constructed of a low frictional surface to facilitate conveyance of the sheet even when the leading-end portion of the sheet slides on it.

Additionally, as shown in FIG. 3B, a notch N is formed in a portion of the forwarding roller 151B facing the gate-side roller 151A in a circumferential direction thereof as shown in FIG. 3A. That is, the notch N is positioned facing the stopper 155A of the gate member 155. With this shape, due to the ratio of the external diameter between them, after making several revolutions, the forwarding roller 151B can face the guide surface 155B without interference with the stopper 155A when the gate member 155 is at the initial position.

Thus, the gate member 155 is designed not only to stop the leading-end portion of the sheet with the stopper 155A but also to increase the width of the portion of the sheet interposed between the forwarding roller 151B and the facing components (gate-side roller 151A and the gate member 155).

Increasing the interposed width of the sheet can facilitate positional adjustment of the sheet in the sheet width direction (hereinafter also "shift adjustment"). More specifically, because the clamping force exerted on the sheet can be alleviated when the interposed area of the sheet is greater in the width direction, damage to the sheet can be reduced in the shift adjustment.

Referring to FIG. 2, the external diameter D of the gate-side roller 151A is determined to satisfy the following relation relative to the distance from the nip between the conveyance rollers 151A and 151B to the nip between the timing rollers 152.

$$T<\pi D$$

wherein T represents the distance between the nip between the timing rollers 152 and the stopper 155A of the gate member 155, and D represents the external diameter of the gate-side roller 151A.

With this configuration, the leading-end portion of the sheet reaches the nip between the timing rollers 152 before the gate-side roller 151A completes one revolution, after which conveyance of the sheet is continued until the gate-side roller 151A completes the revolution, that is, for a duration corresponding to the difference between the circumferential length of the gate-side roller 151A and the distance T. The difference is provided so that the leading-end portion of the sheet can be transported to the nip between the timing rollers 152 reliably.

Although designed to rotate unidirectionally, the gate-side roller 151A is controlled to suspend the rotation simultaneous or substantially simultaneous with, or after the arrival of the stopper 155A of the gate member 155 at the initial position to stop the sheet (hereinafter also "contact position"). Then, the gate-side roller 151A resumes rotation when the sheet contacts the stopper 155A.

Figure 5:
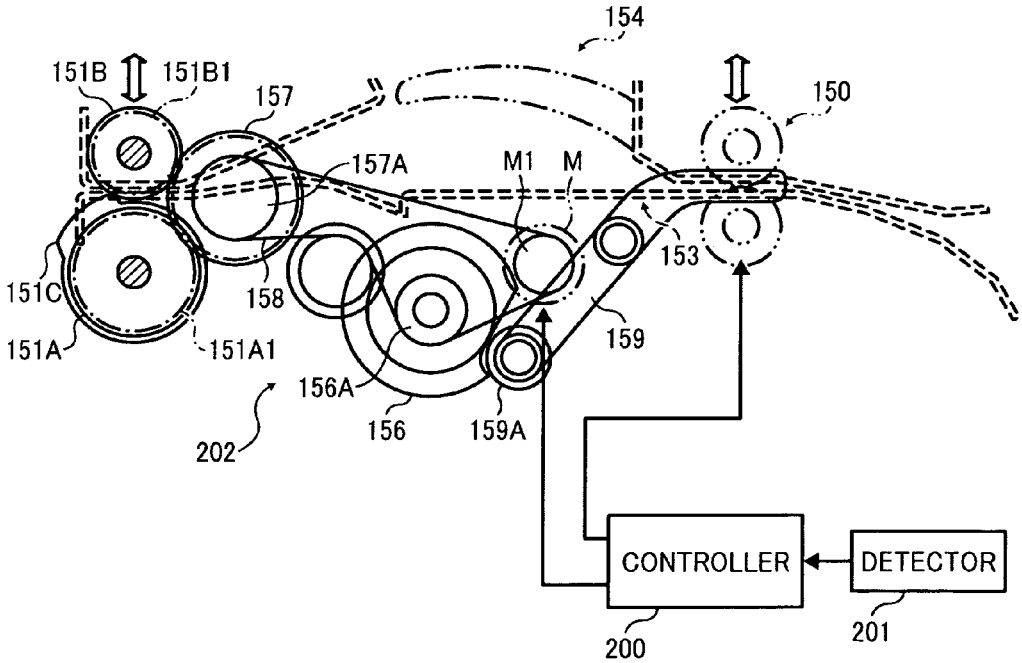
FIG. 5 illustrates a driving mechanism to drive the sheet conveyance unit shown in FIG. 2.

A controller 200 shown in FIG. 5 sets the timing at which the gate-side roller 151A resumes rotation. For example, a detector 201 detects the timing at which the feed rollers 150 start transporting the sheet. The controller 200 computes the amount by which the sheet is forwarded based on the amount by which the feed rollers 150 rotates from the start of sheet conveyance by the feed rollers 150, detected by the detector 201 and then sets when to resume the rotation of the gate-side roller 151A. This is based on the relation between the rotational amount of the feed rollers 150 and the distance from the feed rollers 150 to the stopper 155A of the gate member 155.

In the present embodiment, one of the feed rollers 150 as well as one of the conveyance rollers 151A and 151B is movable toward and away from the opposed roller, that is, can approach and be away from the sheet conveyance path. The unit 202, shown in FIG. 5, for engaging and disengaging the rollers from each other serves as the drive mechanism for this operation. The rollers are designed to move toward and withdraw from the sheet conveyance path so that the roller that currently has a capability of forwarding the sheet can be switched and that the position of the sheet can be adjusted (shift adjustment).

Referring to FIG. 5, the unit 202 includes a drive pulley M1 provided at an output shaft of a single motor M, a cam 156 for shifting the feed roller 150 (hereinafter also "feed roller shifting cam 156"), a pulley 156A provided at a support shaft of the feed roller shifting cam 156, a gear 157 on the side of the conveyance rollers 151A and 151B, a driven pulley 157A provided at the gear 157, and a belt 158 stretched around the pulley 156A and the driven pulley 157A. The controller 200 sets the timing at which the motor M rotates.

The unit 202 further includes a pivotable lever 159 for moving the upper feed roller 150 toward and away from the sheet conveyance path, and a first end portion of the pivotable lever 159 is in contact with a cam surface (i.e., a circumferential surface) of the cam 156 for shifting the feed roller 150.

The pivotable lever 159A is pivotable about a support point with a second end portion thereof in contact with the rotary shaft of one of the feed rollers 150 (in FIG. 5, the lower feed roller 150). Additionally, gears 151A1 and 151B1 are respectively supported by the shafts of the gate-side roller 151A and the forwarding roller 151B, coaxially therewith. The gear 157, provided on the side of the conveyance rollers 151A and 151B, engages the gears 151A1 and 151B1 and rotates the gears 151A1 and 151B1.

The unit 202 for engaging and disengaging the rollers from each other further includes a cam 151C (hereinafter also "conveyance roller shifting cam 151C") supported by the shaft of the gate-side roller 151A, coaxially therewith, for moving the forwarding roller 151B toward and away from the sheet conveyance path. A support portion of the forwarding roller 151B is in contact with a cam surface of the cam 151C. Additionally, the cam 151C for shifting the conveyance roller 151B is in contact with a cam follower 159A provided at the first end portion of the pivotable lever 159 and can rotate in conjunction with rotation of the motor M.

Figure 6A:
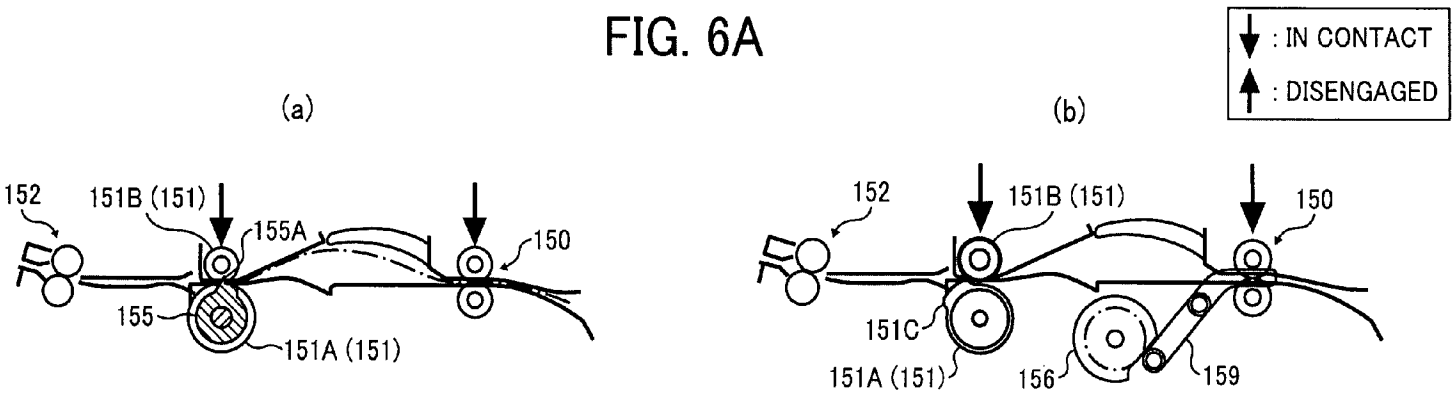
FIGS. 6A through 6D are schematic diagrams that illustrate operations of the gate member and the driving mechanism shown in FIG. 5.
Figure 6B:
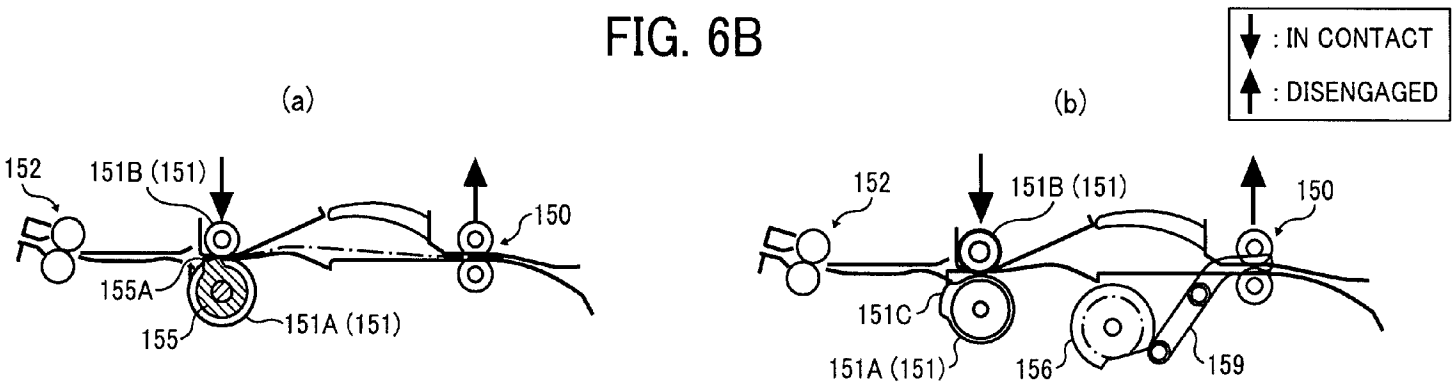
Figure 6C:
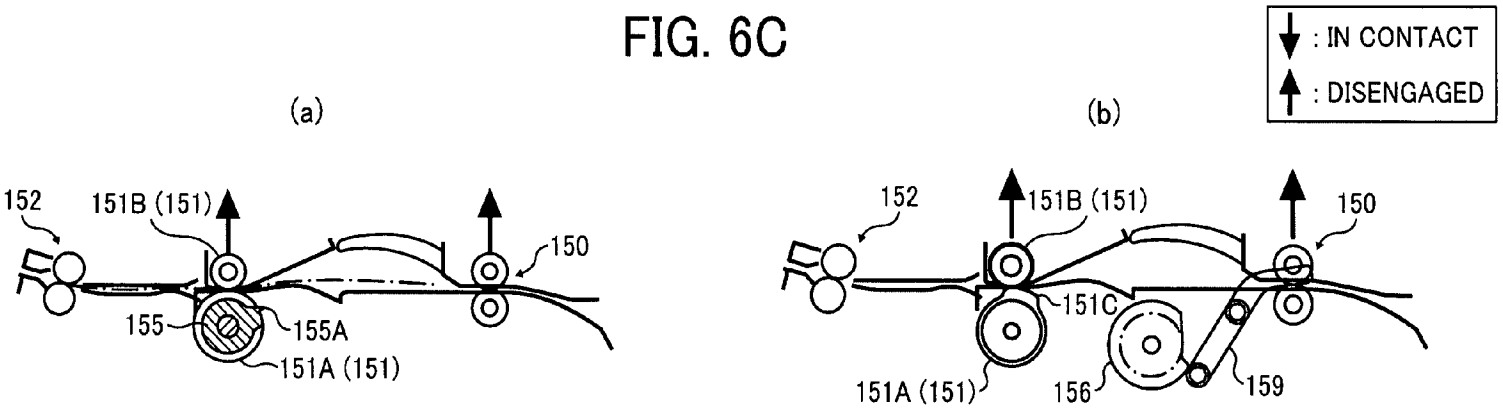
Figure 6D:
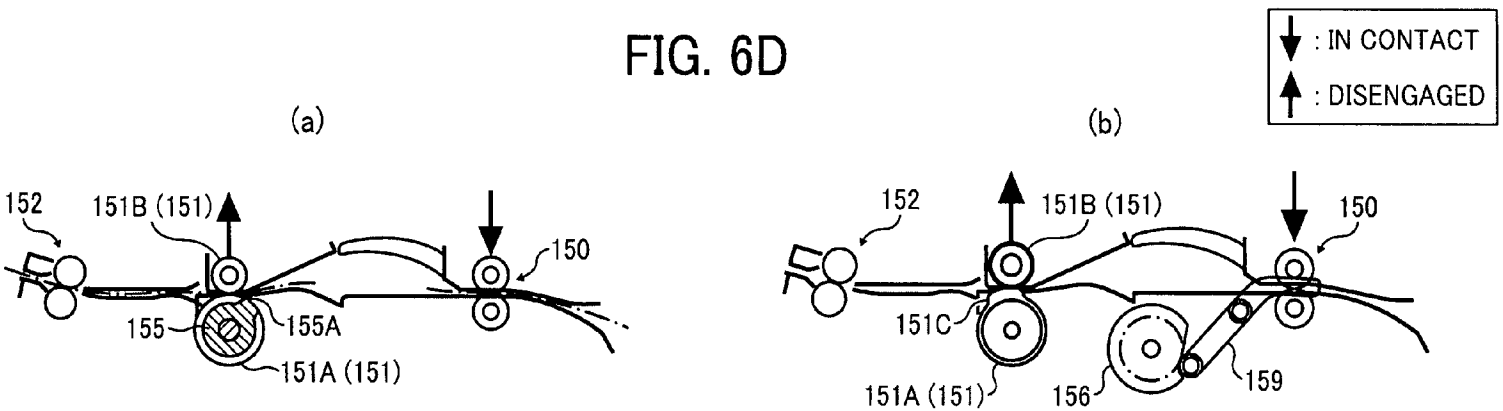
Figure 7:
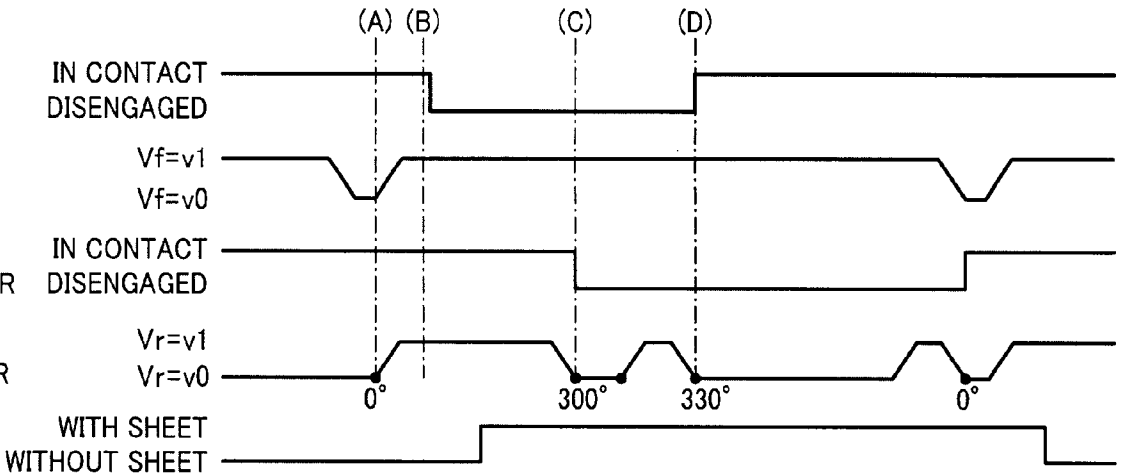
FIG. 7 is a timing chart of the operations of the gate member and the driving mechanism shown in FIGS. 6A through 6D.

FIGS. 6A through 7 illustrate operation to move the upper feed roller 150 and the forwarding roller 151B toward and away from the sheet conveyance path as well as rotational positions of the gate member 155.

FIGS. 6A through 6D illustrate engagement states and disengagement states of the pair of feed rollers 150 and the pair of conveyance rollers 151A and 151B together with the rotational positions of the gate member 155. FIG. 7 is a timing chart that illustrates timings at which the pair of feed rollers 150 and the pair of conveyance rollers 151A and 151B are engaged and disengaged from each other. FIG. 7 includes operational timings of a feed motor to drive the pair of feed rollers 150 and those of a clamping conveyance motor to drive the pair of conveyance rollers 151A and 151B. The controller 200 controls these motors.

Referring to FIG. 6A, when the gate member 155, which moves in conjunction with the gate-side roller 151A, is at the initial position to stop the leading-end portion of the sheet, the feed rollers 150 are in contact with each other (i.e., engagement state), and the conveyance rollers 151A and 151B are in contact with each other. It is to be noted that the phase (rotational position) of the gate member 155 at that time is regarded as 0° for convenience. In other words, referring to FIG. 5, the cam surface of a small-diameter portion of the feed roller shifting cam 156 faces the pivotable lever 159, and the surface of a small-diameter portion of the conveyance roller shifting cam 151C faces the forwarding roller 151B.

With this arrangement, the leading-end portion of the sheet transported by the feed rollers 150 is stopped by the stopper 155A of the gate member 155 provided at the conveyance roller 151A.

The feed rollers 150 are further rotated with the leading-end portion of the sheet stopped by the stopper 155A, causing the sheet to curve like a partial loop. This state is shown in (a) and (b) in FIG. 6A, and corresponds to a timing (A) shown in FIG. 7.

While rotating unidirectionally with the gate-side roller 151A consecutively, the gate member 155 stops temporarily when or about when the stopper 155A arrives at the contact position, or the gate member 155 stops after the stopper 155A arrives at the contact position. Rotation of the gate member 155 is resumed with a signal transmitted by the controller 200. When the gate member 155 has passed the initial position where the portion to stop the sheet (i.e., the stopper 155A) enters the sheet conveyance path, the sheet is transported toward the nip between the timing rollers 152 by the gate-side roller 151A and the forwarding roller 151B in addition to the resilience of the sheet for restoring its original shape.

At that time, the cam 156 for shifting the feed roller 150 rotates to a position where a large-diameter portion of the cam 156 faces the pivotable lever 159, and accordingly the feed roller 150 is moved away from the sheet conveyance path to a non-contact position. This state is shown in FIG. 6B, and corresponds to a timing (B) shown in FIG. 7.

When the sheet forwarded by the pair of conveyance rollers 151A and 151B is caught in the nip between the timing rollers 152, the cam 151C for shifting the conveyance roller 151B is at a position where a large-diameter portion of the cam 151C faces the forwarding roller 151B. Accordingly, the forwarding roller 151B is moved away from the sheet conveyance path. This state is shown in FIG. 6C, and corresponds to a timing (C) shown in FIG. 7.

As the timing rollers 152 clamping the leading-end portion of the sheet state rotating, timed to coincide with the image position, the sheet is transported to the secondary-transfer position. By contrast, the feed rollers 150 return to the engagement state to transport a subsequent sheet. This state is shown in FIG. 6D, and corresponds to a timing (D) shown in FIG. 7.

In the controller 200, the rotational amount of the motor M is set so that the stopper 155A is moved from the non-contact position to the contact position after a trailing-end portion of the sheet passes between the pair of conveyance rollers 151A and 151B.

In the above-described embodiment, the sheet can be stopped and released simply by rotating the gate member 155 consecutively in the unidirectional direction in conjunction with one of the conveyance rollers 151A and 151B. This configuration does not require reverse movement of the gate member 155 in transition between stop of the sheet and release of the sheet. Therefore, waiting time can be reduced and conveyance of the subsequent sheet can be started within a reduced time.

Further, because the pair of conveyance rollers 151A and 151B can be disengaged from each other before the stopper 155A is moved from the non-contact position to the contact position, the stopper 155A does not interfere with the sheet clamped by the pair of conveyance rollers 151A and 151B. Therefore, the sheet can be prevented from getting caught in the nip between the stopper 155A and the conveyance rollers 151A and 151B, and thus deformation of the sheet can be prevented.

The interference between the stopper 155A and the sheet may be prevented by stopping the pair of conveyance rollers 151A and 151B before the stopper 155A is moved from the non-contact position to the contact position.

In addition, the leading-end portion of the sheet to be stopped by the gate member 155 can be reliably guided to the stopper 155A by the guide surface 155B of the gate member 155 provided adjacent to the stopper 155A of the gate member 155. The guide surface 155B of the gate member 155 is also used to transport the sheet clamped between them together with the forwarding roller 151B facing it. Consequently, the pressure to the sheet is not focused but can be dispersed, inhibiting the sheet from skewing or inclining relative to the sheet conveyance direction.

It is to be noted that deformation of or damage to the sheet caused by the contact with the stopper 155A may be prevented by keeping the conveyance rollers 151A and 151B rotating although the conveyance rollers 151A and 151B are disengaged from each other before the stopper 155A is moved from the non-contact position to the contact position. With this operation, because the sheet is not clamped between the conveyance rollers 151A and 151B, the sheet is not caught between the stopper 155A and the nip between the conveyance rollers 151A and 151B, and thus deformation of the sheet can be prevented.

Next, a variation of the above-described embodiment is described below.

Figure 8A:
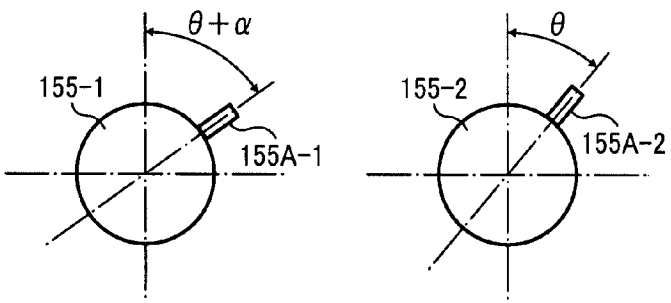
FIGS. 8A and 8B illustrate a variation of the gate member shown in FIG. 5.
Figure 8B:
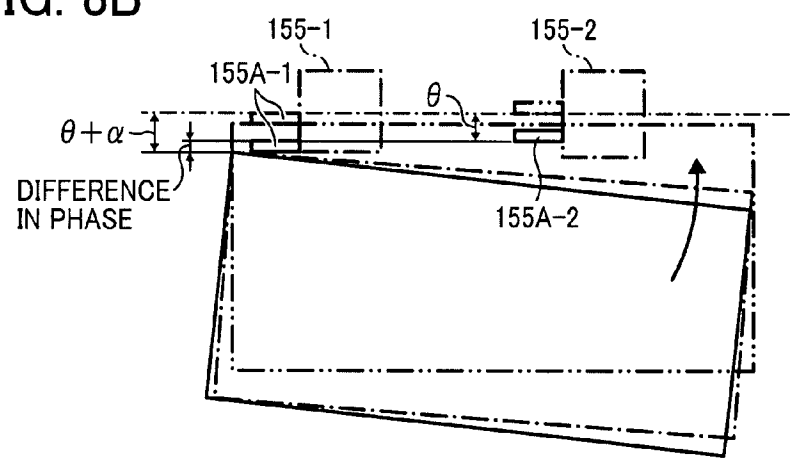

FIGS. 8A and 8B illustrate a configuration in which multiple gate members 155 are arranged in the axial direction of the gate-side roller 151A, and stoppers 155A of the respective gate members 155 can be set at different positions in the circumferential direction of the gate-side roller 151A.

In other words, in such a configuration using multiple gate members 155, for example, the skew of the sheet is corrected as follows. A detector detects passage of a reference edge and the opposite edge of the reference edge in the direction perpendicular to the sheet conveyance direction, and the amount of deviation of the sheet between the reference edge and the opposite edge is calculated. Then, the circumferential position of the stopper 155A of the gate member 155 at the opposite edge is shifted from that of the gate member 155 on a reference side in the axial direction.

FIGS. 8A and 8B are schematic diagrams illustrating differences in circumferential phase between stoppers 155A-1 and 155A-2 (hereinafter also collectively "stoppers 155A") of two gate members 155-1 and 155-2 (hereinafter also collectively "gate members 155").

FIG. 8A illustrates circumferential phases (rotational positions) of the stoppers 155A-1 and 155A-2 of the gate members 155-1 and 155-2 as viewed from an axial end side of the gate-side roller 151A shown in FIG. 5. The gate member 155-1 is positioned on the reference side, whereas the gate member 155-2 is on the opposite side in FIGS. 8A and 8B. The stopper 155A-1 of the gate member 155-1 on the reference side (on left in FIGS. 8A and 8B) is positioned at an angle of $\theta+\alpha$, and the stopper 155A-2 of the gate member 155-2 on the opposite side (on the right in FIGS. A and B) is at an angle of $\theta$.

With the difference in the circumferential phase, the leading-end portion of the sheet comes into contact with the stopper 155A-1 on the reference side before contacting the stopper 155A-2 on the opposite side. When the feed rollers 150 (shown in FIG. 2) keep forwarding the sheet in this state, the leading-end portion of the sheet on the opposite side (on the right in FIG. 8B) rotates about the leading-end portion on the reference side stopped by the stopper 155A-1. Accordingly, the skew of the sheet indicated by solid lines in FIG. 8B is corrected as indicated by broken lines in FIG. 8B.

Because the stoppers 155A-1 and 155A-2 rotate an identical or similar amount (i.e., angle), the position of the sheet on the opposite side is adjusted by an amount corresponding to the difference in circumferential phase. As the sheet is transported, the sheet is substantially aligned with the axial direction perpendicular to the sheet conveyance direction as indicated by broken lines in FIG. 8B.

The above-described difference in circumferential phase is not so large because the amount of skew of the sheet is typically limited. The difference in circumferential phase may be such an amount that, when sheet conveyance is stopped on one side in the sheet width direction, the opposite side of the sheet can be rotated about the portion stopped by the stopper 155A by a force for forwarding the sheet, thus correcting the skew of the sheet.

It is to be noted that, although the description above concerns correcting unintentional skew caused during sheet conveyance, the above-described configuration can address, for example, sheets skewed intentionally in accordance with inclination of an image transfer start end relative to the axial direction.

The shift adjustment is described in further detail below.

The term "shift adjustment" used in this specification means shifting the sheet in the sheet width direction to align a center position of the sheet with a center position of the image in the direction perpendicular to the sheet conveyance direction.

For shift adjustment, the conveyance rollers 151A and 151B are supported by a common housing as the conveyance roller unit 151, the position of the conveyance roller unit 151 in the axial direction is adjusted, and engagement between the feed rollers 150 as well as that between the conveyance rollers 151A and 151B is adjusted.

Figure 11:
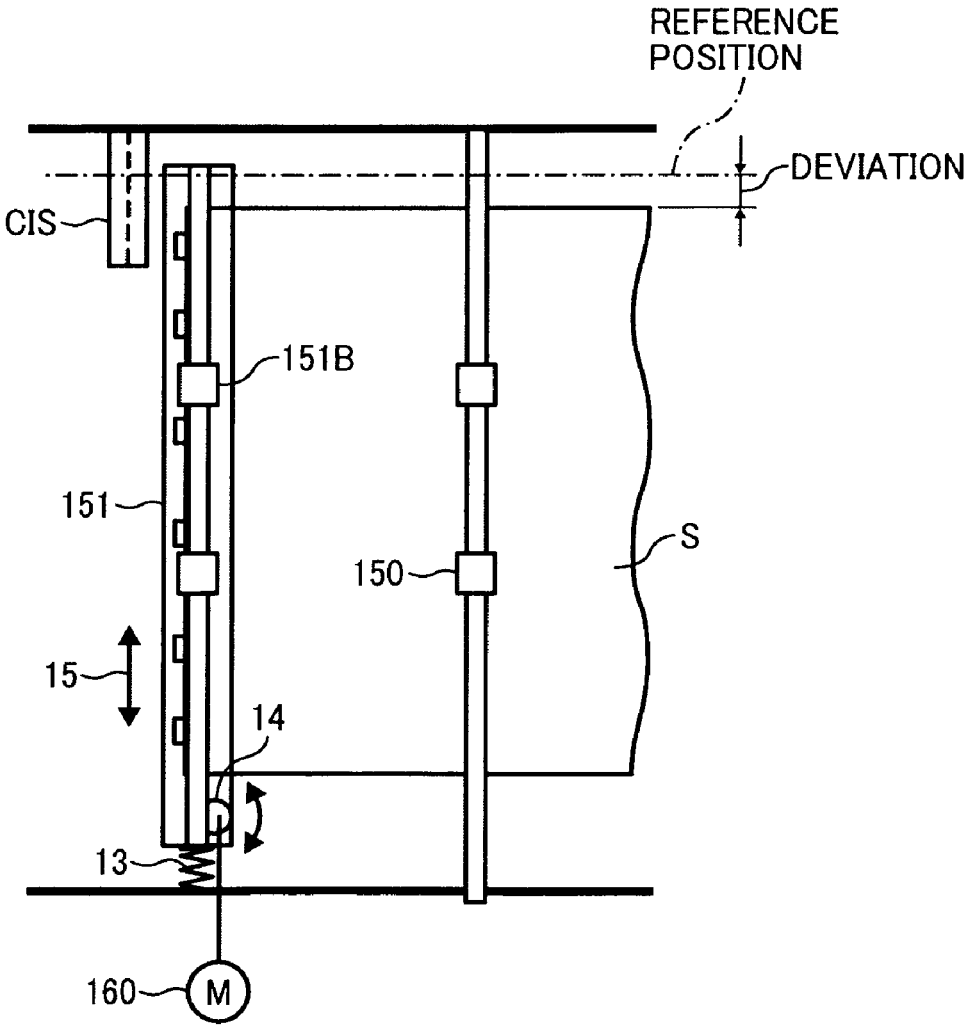
FIG. 11 illustrates a mechanism to move a conveyance roller unit in a sheet width direction.

Referring to FIG. 11, the mechanism for shift adjustment includes a sheet detector CIS to detect the position of the sheet in the sheet width direction, provided in an axial end portion of the shaft of the conveyance rollers 151A and 151B, a cam 14 to move the conveyance roller unit 151 in the axial direction based on detection results by the detector CIS, and a motor 160 to drive the cam 14 (hereinafter "shift motor 160"). The conveyance roller unit 151 is pressed against the cam 14 constantly. As the cam 14 rotates, the conveyance roller unit 151 is moved in the axial direction indicated by arrow 15 shown in FIG. 11 perpendicular to the sheet conveyance direction. It is to be noted that, in FIG. 11, reference number 13 represents a spring, and reference character S represent the sheet.

The cam 14 driven by the shift motor 160 is designed to have a cam profile to move the conveyance roller unit 151 in the axial direction. The cam 14 moves the conveyance roller unit 151 in the axial direction by the amount corresponding to the rotational phase of the shift motor 160, aligning the center position of the sheet with the center position of the image in the sheet width direction. Such a configuration is disclosed in U.S. Pat. No. 7,722,039, which is incorporated by reference herein.

FIGS. 9A through 9D illustrate engagement states and disengagement states between the feed rollers 150 and that between the conveyance rollers 151A and 151B together with the rotational position of the gate member 155 regarding the shift adjustment. FIG. 10 is a timing chart that illustrates timings at which the feed rollers 150 and the conveyance rollers 151A and 151B are engaged and disengaged from each other. It is to be noted that the states shown in FIGS. 9A, 9B, 9C, and 9D are similar to those shown in FIGS. 6A through 6D and are described only briefly below.

Figure 9A:
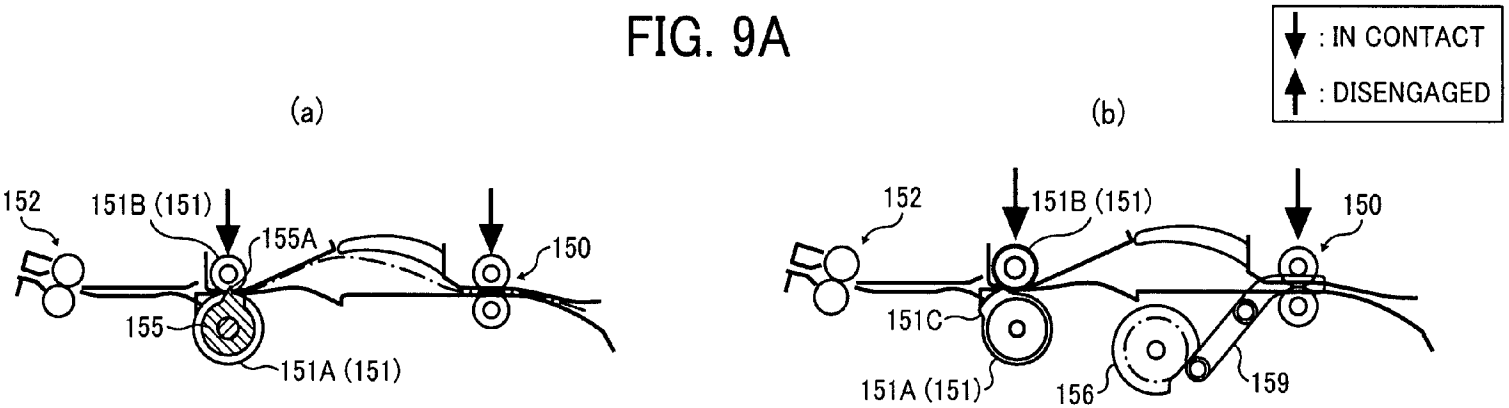
FIGS. 9A through 9D illustrate the gate member and the driving mechanism when shift adjustment is performed in the sheet conveyance unit shown in FIG. 2.
Figure 9B:
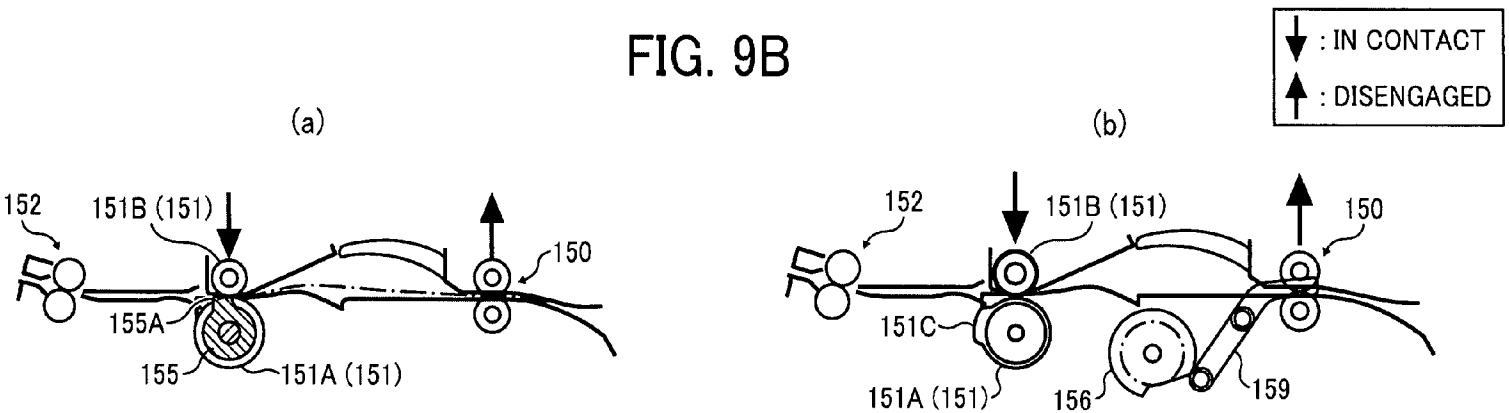
Figure 9C:
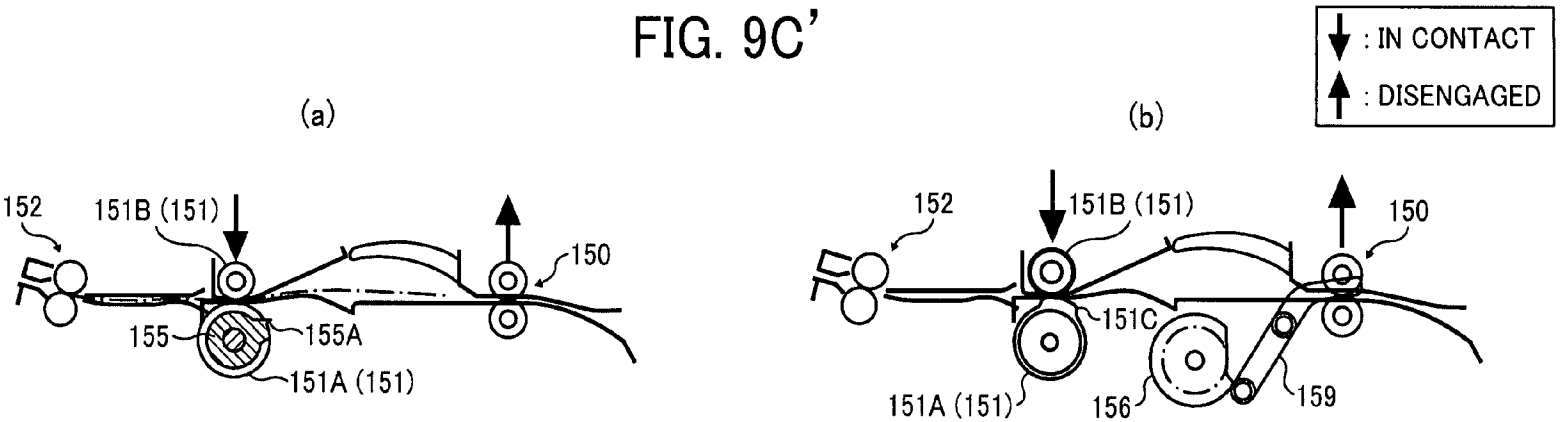
Figure 9C:
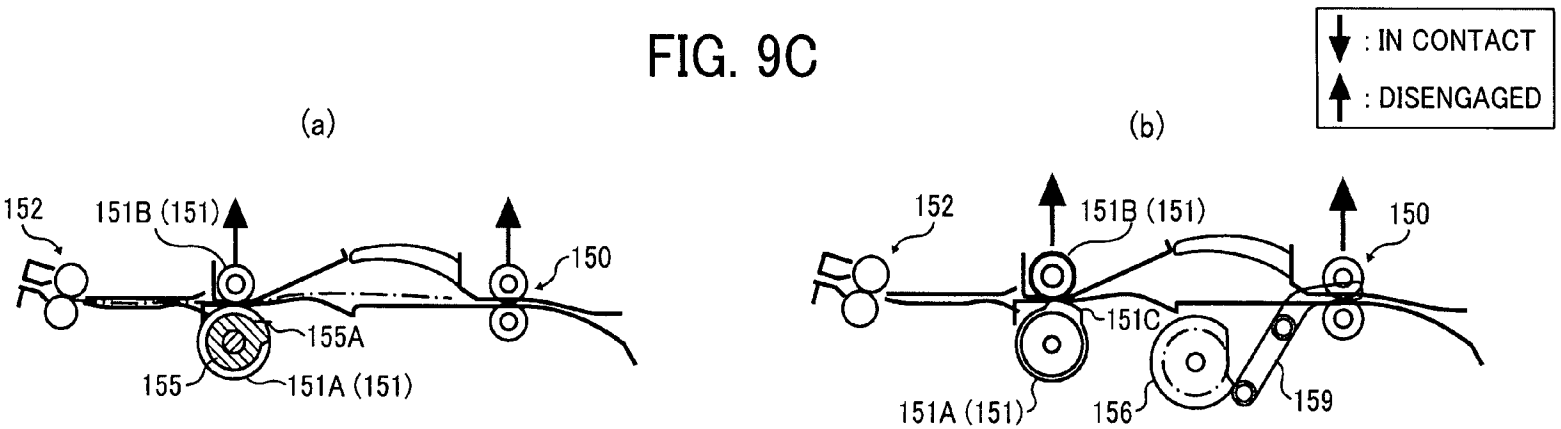
Figure 9D:
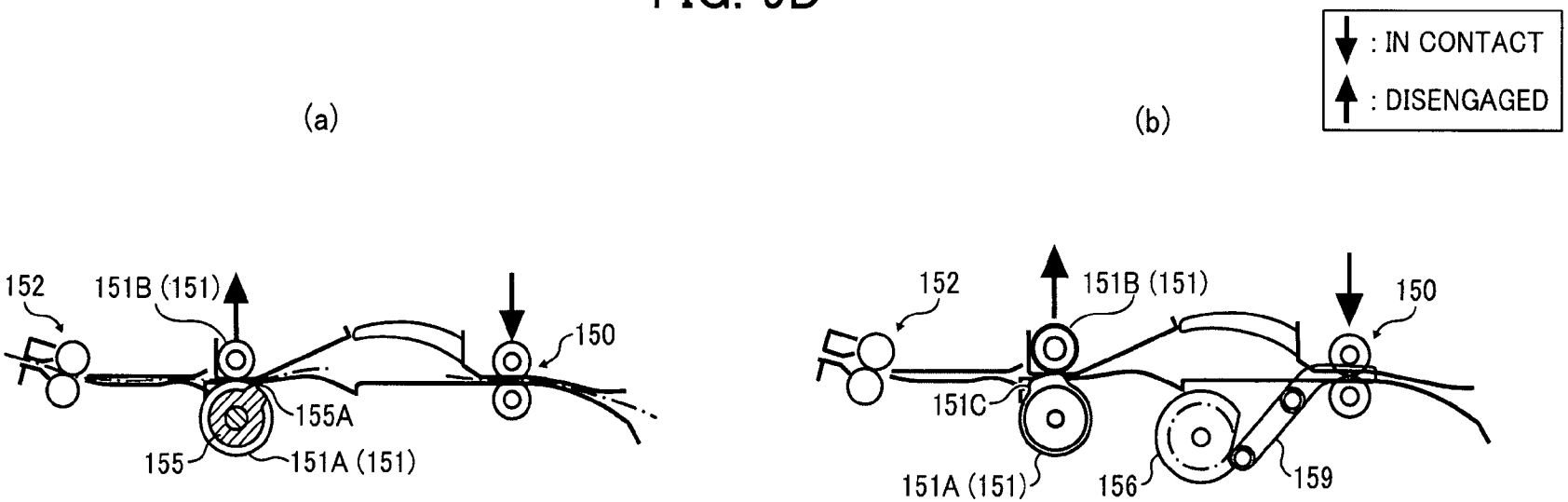
Figure 10:
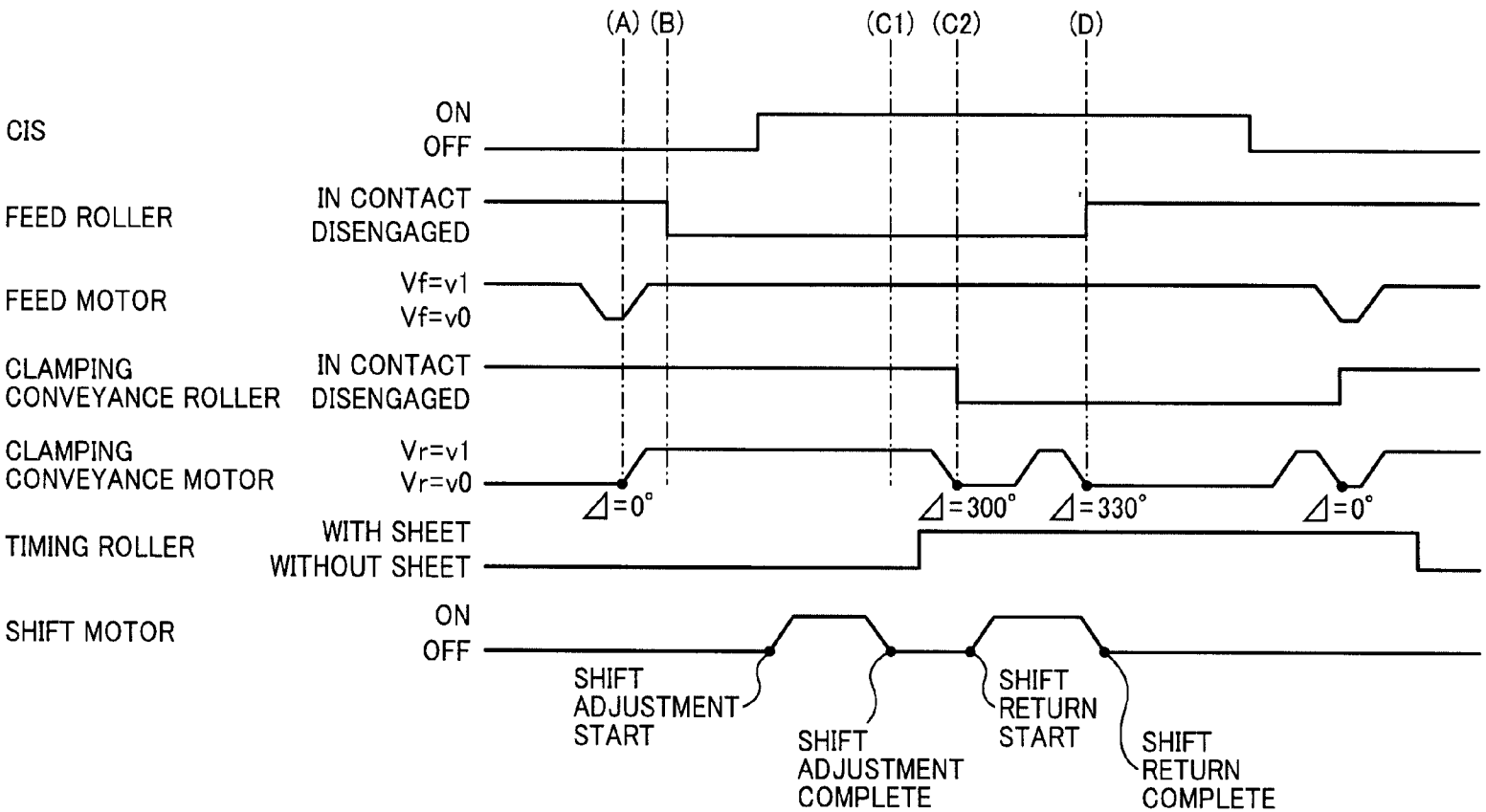
FIG. 10 is a timing chart that illustrates timing phases of respective rollers and the gate member during sheet conveyance shown in FIG. 9A.

The configuration shown in FIGS. 9A through 10 is different in that shift adjustment operation is added from that shown in FIGS. 6A through 7. More specifically, as shown in FIG. 9C' and (C1) in FIG. 10, the conveyance rollers 151A and 151B are kept in contact with each other until the gate member 155 rotates to an angle of about 260° unidirectionally similarly to the period during which the gate member 155 rotates from the initial position to an angle of about 30° unidirectionally as shown in FIG. 9B. At that time, the feed rollers 150 are disengaged from each other.

In this state, according to the detection result generated by the detector CIS shown in FIG. 10, the position of the conveyance roller unit 151 in the axial direction is set with the cam 14 that moves from the initial position shown in FIG. 9A, driven by the shift motor 160.

With this adjustment, the sheet clamped between the pair of conveyance rollers 151A and 151B is forwarded to the timing rollers 152 with the center position of the sheet aligned with the center position of the image or a predetermined reference position in the sheet width direction.

The sheet aligned in the sheet width direction and transported by the pair of conveyance rollers 151A and 151B is caught in the nip between the timing rollers 152 as shown in FIG. 9C and (C2) in FIG. 10. Then, the timing rollers 152 forward the sheet, timed to coincide with the position of the image. When the timing rollers 152 transport the leading-end portion of the sheet caught in the nip therebetween, one of the conveyance rollers 151A and 151B is away from the sheet conveyance path similarly to the state shown in FIG. 6C.

As the timing rollers 152 clamping the leading-end portion of the sheet state rotating, timed to coincide with the image position, the sheet is transported to the secondary-transfer position. By contrast, the feed rollers 150 return to the engagement state to transport a subsequent sheet. This state is shown in FIG. 9D, and corresponds to a timing (D) shown in FIG. 10.

In the above-described configuration, while the conveyance rollers 151A and 151B make one revolution, alignment of the sheet in the sheet width direction in addition to the skew correction of the sheet can be performed in succession, which can reduce loss of time caused when different operations, that is, skew correction and alignment in the width direction of the sheet in the present embodiment, are performed.

In the above-described embodiment, the gate member 155 to stop the leading-end portion of the sheet is provided coaxially with one of the conveyance rollers 151A and 151B and configured to rotate unidirectionally and consecutively in conjunction with rotation of the conveyance roller 151A. It is not necessary to switch the rotational direction of the gate member 155. Consequently, loss of time caused by the switch of the rotational direction of the gate member 155 can be eliminated.

Additionally, because the distance by which the sheet is transported by one revolution of the conveyance rollers 151A and 151B is greater than the distance from the nip between the conveyance rollers 151A and 151B to the nip between the timing rollers 152, the shift adjustment can be performed in the duration of time corresponding to the difference in distance. That is, the position of the sheet in the direction perpendicular to the sheet conveyance direction can be adjusted.

As a result, when the sheet is forwarded to the timing rollers 152 using the resilience of the curved sheet, alignment of the leading-end portion of the sheet with the image position in the sheet conveyance direction as well as alignment of the sheet with the image transfer position in the sheet width direction can be performed while the conveyance rollers 151A 151B rotate. Thus, multiple different operations can be performed together with unidirectional rotation of the conveyance rollers 151A and 151B, thus reducing loss of time.

In addition, the sheet that is curved into a partial loop is guided by the guide surface 155B of the gate member 155 to the nip between the conveyance rollers 151A and 151B. Thus, the gate member 155 has multiple capabilities.

Moreover, before the stopper 155A of the gate member 155 is moved from the non-contact position to the contact position, the conveyance rollers 151A and 151B are stopped or disengaged from each other to prevent the stopper 155A from contacting the sheet clamped between the conveyance rollers 151A and 151B. Accordingly, deformation of and damage to the sheet can be prevented or reduced.

Numerous additional modifications and variations are possible in light of the above teachings. It is therefore to be understood that, within the scope of the appended claims, the disclosure of this patent specification may be practiced otherwise than as specifically described herein.

What is claimed is:

1. A sheet conveyance unit comprising:

a first conveyance roller and a second conveyance roller disposed facing each other via a sheet conveyance path along which a sheet of recording media is transported;

a first stopper provided at an axial end portion of the first conveyance roller and projecting beyond a circumferential surface of the first conveyance roller in a radial direction of the first conveyance roller, to rotate to a contact position projecting into the sheet conveyance path to stop the sheet and to a non-contact position away from the sheet conveyance path in conjunction with rotation of the first conveyance roller;

a pair of downstream rollers positioned downstream from the first and second conveyance rollers in a sheet conveyance direction in which the sheet is transported;

an engaging and disengaging unit to engage and disengage the first and second conveyance rollers from each other; and a controller operatively connected to the first and second conveyance rollers as well as the engaging and disengaging unit, to move the first stopper to the non-contact position after the first stopper stops the sheet and to cause the engaging and disengaging unit to disengage the first and second conveyance rollers from each other after a leading-end portion of the sheet arrives at the pair of downstream rollers and before the first stopper is moved from the non-contact position to the contact position.

2. The sheet conveyance unit according to claim 1, wherein the first stopper is supported by a rotary shaft of the first conveyance roller.

3. The sheet conveyance unit according to claim 1, wherein the first stopper is rotated unidirectionally.

4. The sheet conveyance unit according to claim 1, further comprising a second stopper projecting beyond the circumferential surface of the first conveyance roller in the radial direction of the first conveyance roller, provided coaxially with the first stopper and the first conveyance roller, wherein the second stopper is at a different position from a position of the first stopper in a circumferential direction of the first conveyance roller to adjust an inclination of the sheet relative to the sheet conveyance direction.

5. The sheet conveyance unit according to claim 1, wherein the first stopper projects where the second conveyance roller facing the first conveyance roller is not present.

6. The sheet conveyance unit according to claim 1, wherein the first stopper is adjacent to an edge surface of the first conveyance roller in an axial direction thereof.

7. An image forming apparatus comprising:

an image forming unit; and a sheet conveyance unit comprising:

a first conveyance roller and a second conveyances disposed facing each other via a sheet conveyance path along which a sheet of recording media is transported;

a first stopper provided at an axial end portion of the first conveyance roller and projecting beyond a circumferential surface of the first conveyance roller in a radial direction of the first conveyance roller, to rotate to a contact position projecting into the sheet conveyance path to stop the sheet and to a non-contact position away from the sheet conveyance path as the first conveyance roller rotates;

a pair of downstream rollers positioned downstream from the first and second conveyance rollers in a sheet conveyance direction in which the sheet is transported;

an engaging and disengaging unit to engage and disengage the first and second conveyance rollers from each other; and a controller operatively connected to the first and second conveyance rollers as well as the engaging and disengaging unit, to move the first stopper to the non-contact position after the first stopper stops the sheet and to cause the engaging and disengaging unit to disengage the first and second conveyance rollers from each other after a leading-end portion of the sheet arrives at the pair of downstream rollers and before the first stopper is moved from the non-contact position to the contact position.

8. A sheet conveyance unit, comprising:

a first conveyance roller and a second conveyance roller disposed facing each other via a sheet conveyance path along which a sheet of recording media is transported;

a first stopper provided coaxially on a rotary shaft of the first conveyance roller and projecting beyond a circumferential surface of the first conveyance roller in a radial direction of the first conveyance roller, to rotate to a contact position projecting into the sheet conveyance path to stop the sheet and to a non-contact position away from the sheet conveyance path in conjunction with rotation of the first conveyance roller;

a pair of downstream rollers positioned downstream from the first and second conveyance rollers in a sheet conveyance direction in which the sheet is transported;

an engaging and disengaging unit to engage and disengage the first and second conveyance rollers from each other; and a controller configured to control the engaging and disengaging unit, to move the first stopper to the non-contact position after the first stopper stops the sheet and to cause the engaging and disengaging unit to disengage the first and second conveyance rollers from each other after a leading-end portion of the sheet arrives at the pair of downstream rollers and before the first stopper is moved from the non-contact position to the contact position.

9. The sheet conveyance unit according to claim 8, wherein the controller stops the first and second conveyance rollers simultaneously when or after the reengaging and disengaging unit disengages the first and second conveyance rollers from each other.

10. The sheet conveyance unit according to claim 8, wherein the controller moves the first stopper from the non-contact position to the contact position after a trailing-end portion of the sheet passes between the first and second conveyance rollers.

11. The sheet conveyance unit according to claim 8, further comprising a sheet guide provided at the axial end portion of the first conveyance roller, having a diameter identical to a diameter of the first conveyance roller.

12. The sheet conveyance unit according to claim 11, wherein the sheet guide has a circumferential surface of a low frictional coefficient.

13. The sheet conveyance unit according to claim 11, wherein the sheet guide is continuous with the first stopper and positioned upstream from the first stopper in the sheet conveyance direction.

14. The sheet conveyance unit according to claim 11, wherein a recess is formed in a circumferential surface of the second conveyance roller, in an axial end portion facing the sheet guide, to engage the first stopper provided at the first conveyance roller.

15. The sheet conveyance unit according to claim 8, wherein an external diameter of the first conveyance roller and a distance from a center of rotation of the first conveyance roller to a center of rotation of the downstream conveyance roller satisfies $$T<\pi D$$

wherein T represents the distance from the center of rotation of the first conveyance roller to the center of rotation of the downstream conveyance roller, and D represents the external diameter of the first conveyance roller.

16. The sheet conveyance unit according to claim 8, further comprising a pair of feed rollers positioned facing each other via the sheet conveyance path, upstream from the first and second conveyance rollers in the sheet conveyance direction, the pair of feed rollers is driven with the leading-end portion of the sheet in contact with the first stopper to deform the sheet into a partial loop, and the engaging and disengaging unit engages and disengages the feed rollers from each other in addition to the first and second conveyance rollers.

17. The sheet conveyance unit according to claim 16, wherein the engaging and disengaging unit comprises:

a motor;

a first cam to rotate in conjunction with the motor, provided coaxially with one of the first conveyance roller and the second conveyance roller;

a pivotable arm pivotable with a first end portion thereof in contact with a rotary shaft of one of the feed rollers;

a cam follower provided at a second end portion of the pivotable arm opposite the first end portion of the pivotable arm;

a second cam positioned in contact with the cam follower, to rotate in conjunction with the motor, wherein timings to engage and disengage the first and second conveyance rollers from each other are determined by phases of a cam profile of the first cam, and timings to engage and disengage the feed rollers from each other are determined by phases of a cam profile of the second cam.

18. An image forming apparatus, comprising:

an image forming unit; and a sheet conveyance unit including:

a first conveyance roller and a second conveyance s disposed facing each other via a sheet conveyance path along which a sheet of recording media is transported;

a first stopper provided coaxially on a rotary shaft of the first conveyance roller and projecting beyond a circumferential surface of the first conveyance roller in a radial direction of the first conveyance roller, to rotate to a contact position projecting into the sheet conveyance path to stop the sheet and to a non-contact position away from the sheet conveyance path as the first conveyance roller rotates;

a pair of downstream rollers positioned downstream from the first and second conveyance rollers in a sheet conveyance direction in which the sheet is transported;

an engaging and disengaging unit to engage and disengage the first and second conveyance rollers from each other; and a controller configured to control the engaging and disengaging unit, to move the first stopper to the non-contact position after the first stopper stops the sheet and to cause the engaging and disengaging unit to disengage the first and second conveyance rollers from each other after a leading-end portion of the sheet arrives at the pair of downstream rollers and before the first stopper is moved from the non-contact position to the contact position.

19. The image forming apparatus according to claim 18, wherein the first stopper projects where the second conveyance roller facing the first conveyance roller is not present.

20. The image forming apparatus according to claim 18, wherein the first stopper is adjacent to an edge surface of the first conveyance roller in an axial direction thereof.

* * * * *